US006347816B1

(12) United States Patent
Donaho

(10) Patent No.: US 6,347,816 B1
(45) Date of Patent: Feb. 19, 2002

(54) METHODS FOR TYING KNOTS IN ROPES

(76) Inventor: Glynn Donaho, 3400 Russell Ave., St. Louis, MO (US) 63104

( * ) Notice: Subject to any disclaimer, the term of this patent is extended or adjusted under 35 U.S.C. 154(b) by 0 days.

(21) Appl. No.: 09/636,173

(22) Filed: Aug. 10, 2000

(51) Int. Cl.[7] ..... B65H 69/04
(52) U.S. Cl. ..... 289/1.5; 289/1.2; 289/18.1
(58) Field of Search ..... 289/1.2, 1.5, 2, 289/17, 18.1; 273/440; 472/81, 137

(56) References Cited

U.S. PATENT DOCUMENTS 3,612,587 A * 10/1971 Rubin ..... 289/1.2
4,008,643 A * 2/1977 Young ..... 289/18.1
4,008,912 A * 2/1977 Kotov ..... 289/1.2
4,101,152 A * 7/1978 Gardipee ..... 289/17

* cited by examiner

*Primary Examiner*—John J. Calvert
*Assistant Examiner*—Gary L. Welch
(74) *Attorney, Agent, or Firm*—Armstrong Teasdale LLP

(57) ABSTRACT

A method permits a knot to be tied in a rope that is being held with one hand. The rope includes a first end and a weighted second end, and has a length extending therebetween that permits a user implementing the method to tie a knot therein. Initially the rope is held in one hand such that the weighted second end of the rope is suspended and the rope is taut between the hand and the second end. Moving the hand holding the rope in a first direction and in a second direction causes a loop to form between the hand and the rope second end. As the rope is moved in the opposite direction, momentum permits the rope weighted end to pass through the rope loop to form a knot.

16 Claims, 3 Drawing Sheets

METHODS FOR TYING KNOTS IN ROPES

BACKGROUND OF THE INVENTION

This application relates generally to knots and, more particularly, to methods for tying knots.

Objects or toys that provide challenges and require individual dexterity often provide countless hours of entertainment for children and adults. Despite technological advances, often the most popular toys among adults and children are fabricated with basic components, yet still provide a continuous challenge to the user and still require individual dexterity for the user to successfully overcome the challenge provided by the object.

Objects that satisfy the above-mentioned criteria can be as simple as yo-yo's. Yo-yos typically are fabricated with basic components, including string, but still provide a challenge. Learning to use a yo-yo may take only a matter of minutes, but mastering tricks takes considerable practice and patience.

Another object that satisfies the above-mentioned criteria may be a piece of string tied in a loop. Learning to tie your shoelaces typically only provides a short-term challenge, but learning to perform tricks with the looped string, such as Jacob's Ladder, may provide countless hours of entertainment and challenges to a user. Additionally, children often carry ropes that include lassos in an attempt to imitate scene from western movies. For the children, learning to coil the rope and learning to tie a lasso into the rope takes only a matter of minutes, but learning to throw the lasso to ensnare something takes considerable practice and patience.

BRIEF SUMMARY OF THE INVENTION

In an exemplary embodiment, a method permits a knot to be tied in a rope that is being held with one hand. The rope includes a first end and a weighted second end, and has a length extending therebetween that permits a user implementing the method to tie a knot therein.

In the exemplary embodiment, initially the rope is held in one hand such that the weighted second end of the rope is suspended and the rope is taut between the hand and the second end. The hand moves the rope quickly in a first direction such that the rope slackens to form a loop between the hand and the rope second end. The rope is then quickly moved in an opposite direction and because the second end is weighted, the rope second end initially continues in the first direction and passes through the loop to tie the knot. The rope second end then moves to complete the method for tying a knot in a rope.

DETAILED DESCRIPTION OF THE INVENTION

Figure 1:
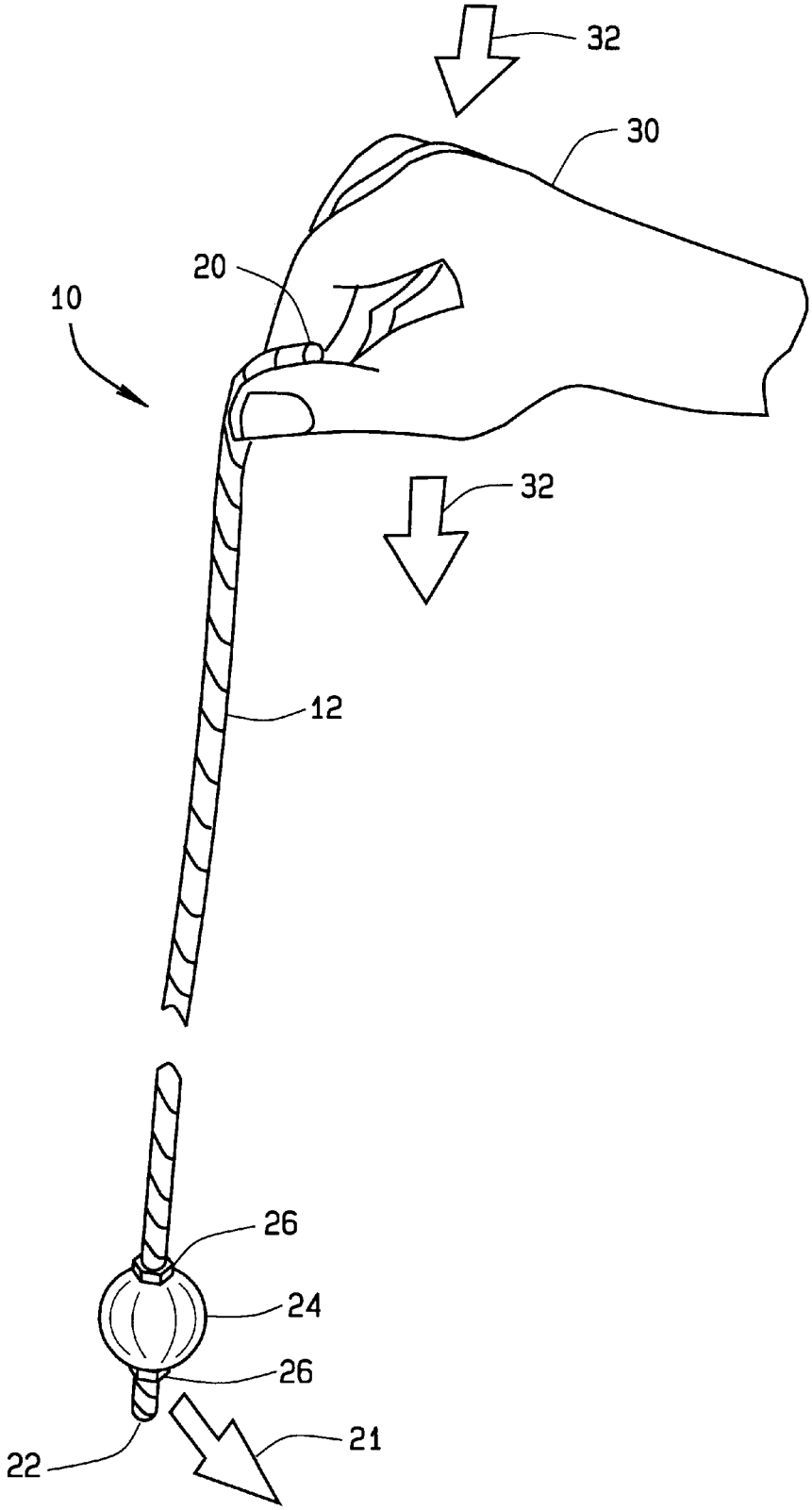
FIG. 1 is a side view illustrating a starting position for a method for tying a knot in a rope.
Figure 2:
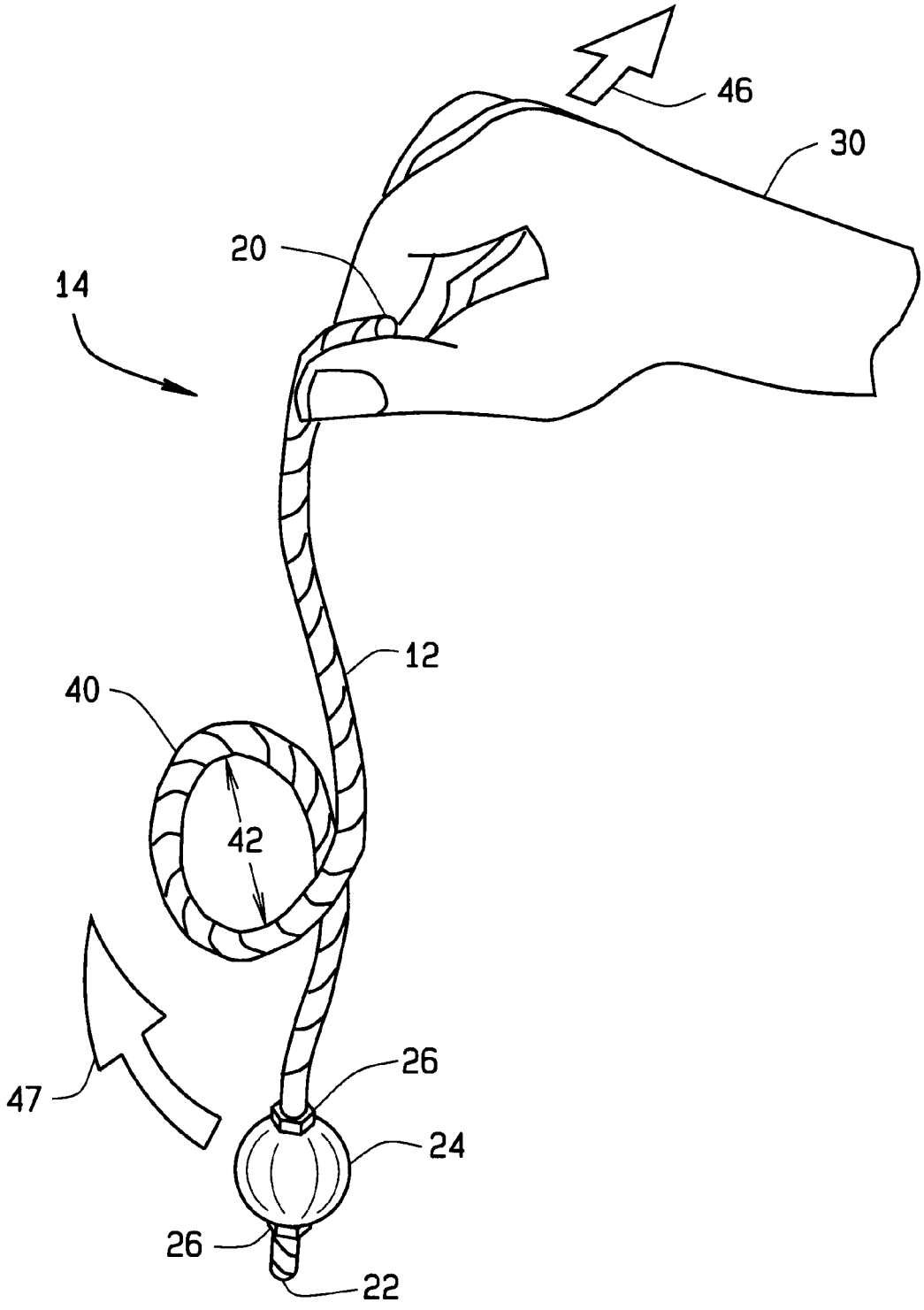
FIG. 2 is a side view illustrating an intermediate position of the method for tying a knot in a rope.
Figure 3:
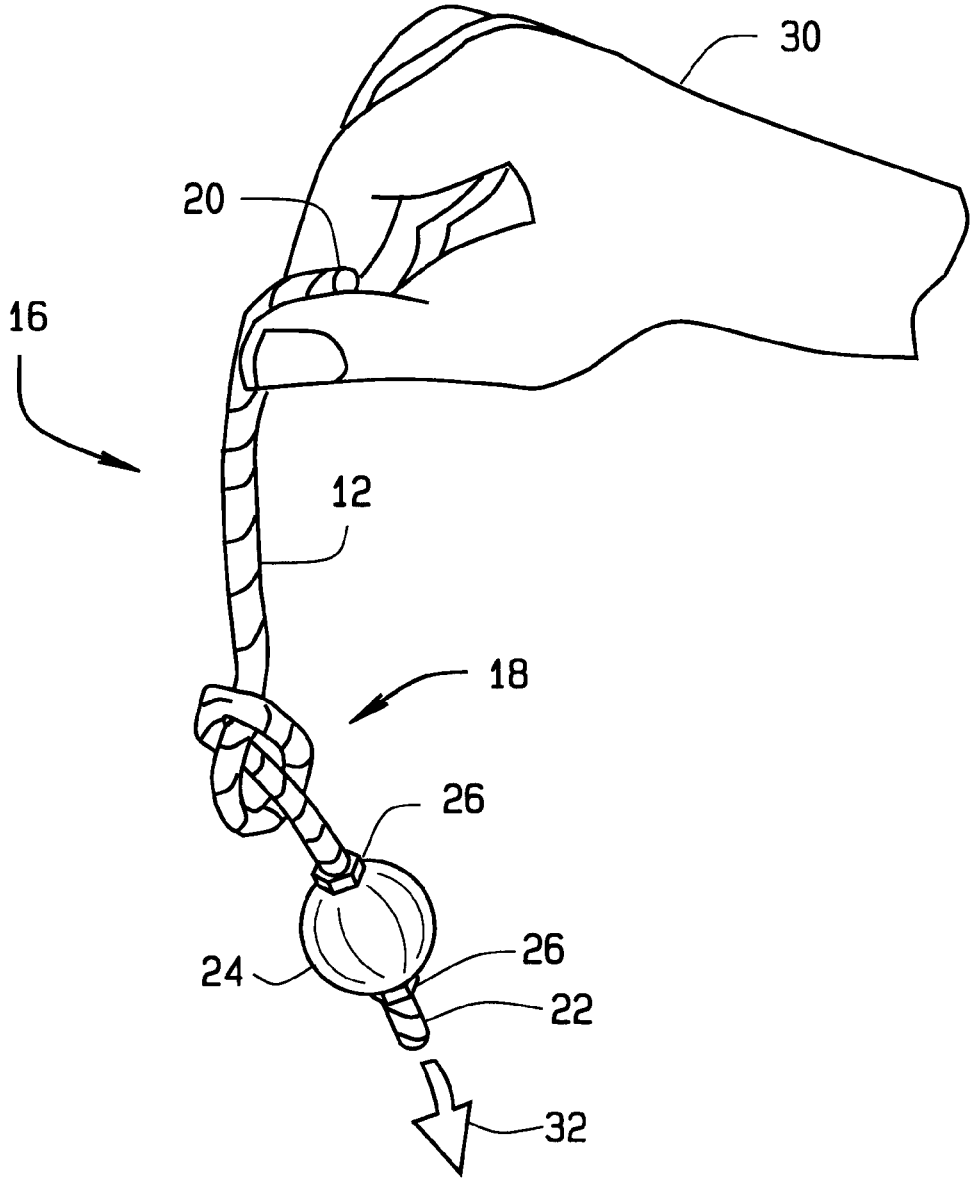
FIG. 3 is a side view illustrating a finishing position of the method for tying a knot in a rope.

FIG. 1 is a side view illustrating a starting position 10 for a method for tying a knot (not shown in FIG. 1) in a rope 12. FIGS. 2 and 3 are side view illustrating an intermediate and a finishing position 14 and 16, respectively, for the method for tying a knot 18 in rope 12. Rope 12 has a length (not shown) extending between a first end 20 and a weighted second end 22. The rope length is long enough to permit knot 18 to be tied and short enough such that when rope 12 is held, rope second end 22 is a distance (not shown) above the floor (not shown). In an alternative embodiment, the method may be used to tie knot 18 in a cord, a cable, a string, or any other flexible material having a length sufficient to permit a knot to be tied.

In an exemplary embodiment, rope second end 22 includes a wooden ball 24 held in place with a pair of knots 26. Wooden ball 24 ensures rope 12 is taut when rope first end 20 is held in a person's hand 30. Alternatively, rope second end 22 includes, but is not limited to, an additional knot, a washer, a nut, a bolt, or any other item which provides weight to rope second end 22 such that as rope first end 20 is held, rope 12 is taut between rope first and second ends 20 and 22, respectively. In another alternative embodiment, rope 12 has significant weight such that rope second end 22 does not include any additional weight.

Initially, as shown in FIG. 1, rope first end 20 is held in a person's hand 30 and rope second end 22 extends from hand 30 and is suspended, such that rope 12 is substantially taut between hand 30 and rope second end 22. As such, because rope 12 does not include any slack between hand 30 and rope second end 22, a linear distance (not shown) measured between hand 30 and rope second end 22 is maximized relative to rope 12 being used.

In the exemplary embodiment, hand 30 is moved quickly in a first direction, indicated by arrow 32, such that rope first end 20 is moved closer to rope second end 22, and such that an angled direction 21 is imparted by the movement of hand 30 to second end 22 of rope 12. As a result of hand movement, rope 12 is transitioned from starting position 10 into intermediate position 14, and rope 12 slackens between rope first and second ends 20 and 22, respectively. At intermediate position 14, the linear distance (not shown) of rope 12 is reduced in comparison to the maximized liner distance measured when rope 12 was in starting position 10.

As the linear distance between rope first and second ends 20 and 22 is reduced, rope 12 slackens to form a loop 40 between rope second end 22 and hand 30. A diameter 42 of loop 40 is variable depending on amount of slack induced within rope 12.

Hand 30 is then moved quickly in a second direction, indicated by arrow 46, and then hand 30 is held substantially still. Second direction 46 is substantially opposite first direction 32. As a result, despite movement of hand 30 stopping, rope second end 22 reverses direction and moves towards hand 30. More specifically, rope second end 22 is propelled towards rope loop 40 in a direction 47 that is substantially opposite direction 21.

Because rope second end 22 is weighted, the initial movement of hand 30 in second direction 46 creates additional momentum in rope second end 22 in comparison to momentum created in loop 40. The difference in momentum induced within rope second end 22 and rope loop 40, permits rope second end 22 to move between hand 30 and loop 40, at which time gravitational pull overcomes the momentum and rope second end 22 falls away from hand 30 and through loop 40 into finishing position 16, such that knot 18 is tied in rope 12. In an alternative embodiment, rope second end 22 passes through loop 40 in second direction 46, at which time gravitation overcomes the momentum and rope second end 22 moves outside of loop 40. In a second alternative embodiment, hand 30 is not moved in direction 46 until rope second end 22 has passed through loop 40.

To tie additional knots 18 in rope 12, the above-mentioned method is repeated.

Variations of the above-described embodiment are possible. For example, in an alternative embodiment, hand 30 is moved quickly from starting position 10 in a first direction, indicated by arrow 46, and then in a second direction, indicated by arrow 32, such that initially rope second end 22 is moved closer to rope first end 20. As a result of hand movement, rope 12 is transitioned from starting position 10 into an intermediate position similar to intermediate position 14, and rope 12 slackens between rope first and second ends 20 and 22, respectively. At such an intermediate position, the linear distance (not shown) of rope 12 is reduced in comparison to the maximized liner distance measured when rope 12 was in starting position 10.

As the linear distance between rope first and second ends 20 and 22 is reduced, rope 12 slackens to form loop 40 between rope second end 22 and hand 30. After hand 30 is moved in second direction 32, hand 30 is then held substantially still. Second direction 32 is substantially opposite first direction 46. Because of momentum, rope second end 22 continues towards hand 30 after the movement of hand 30 has stopped.

The difference in momentum induced within rope second end 22 and rope loop 40, permits rope second end 22 to move towards hand 30 while loop 40 is simultaneously directed away from hand 30. As a result, rope second end 22 is propelled through loop 40, at which time gravitation overcomes the momentum and rope second end 22 moves away from hand 30, such that knot 18 is tied in rope 12.

While the invention has been described in terms of various specific embodiments, those skilled in the art will recognize that the invention can be practiced with modification within the spirit and scope of the claims.

What is claimed is:

1. A method of tying a knot in a rope using only one hand, the rope including a first end and a second end, said method comprising the steps of:

holding the second end of the rope in a hand;

moving the second end of the rope in a first direction while maintaining a grip on the second end of the rope;

moving the second end of the rope in a second direction opposite the first direction while maintaining a grip on the second end of the rope; and stopping the motion of the second end of the rope such that the first end of the rope travels in the first direction and then travels in the second direction such that a knot is tied in the rope between the rope first and second ends.

2. A method in accordance with claim 1 wherein said step of moving the second end of the rope in a first direction further comprises the step of moving the second end of the rope to form a loop in the rope between the rope first and second ends.

3. A method in accordance with claim 2 wherein said step of moving the second end of the rope in a second direction further comprises the step of forcing the first end of the rope towards the loop.

4. A method in accordance with claim 3 wherein said step of stopping the motion of the second end of the rope further comprises the step of forcing the first end of the rope through the loop in the first direction.

5. A method in accordance with claim 3 wherein said step of stopping the motion of the second end of the rope further comprises the step of permitting the first end of the rope to pass through the loop in the second direction.

6. A method in accordance with claim 1 wherein said step of moving the second end of the rope further comprises the step of simultaneously moving the second end of the rope to form a loop in the rope between the rope first and second ends and permitting the first end of the rope to travel in the first direction through the loop.

7. A method in accordance with claim 1 further comprising the step of weighting the first end of the rope prior to tying a knot in the rope.

8. A method in accordance with claim 1 further comprising the step of repeating the steps recited in claim 1 to form a plurality of knots in the rope.

9. A method of tying a knot in a rope that includes a first end and a second end, said method comprising the steps of:

holding only the first end of the rope moving the rope to form a loop in the rope between the first and second ends of the rope; and moving the rope such that the second end of the rope is inserted through the loop.

10. A method in accordance with claim 9 wherein said step of moving the rope to form a loop further comprises the steps of:

moving the first end of the rope in a first direction while maintaining a grip on the first end of the rope; and moving the first end of the rope in a second direction opposite the first direction, while maintaining a grip on the first end of the rope.

11. A method in accordance with claim 10 wherein said step of moving the first end of the rope further comprises the step of moving the second end of the rope towards the loop.

12. A method in accordance with claim 11 wherein said step of moving the second end of the rope further comprises the step of moving the second end of the rope such that the second end of the rope passes through the loop in the first direction.

13. A method in accordance with claim 11 wherein said step of moving the second end of the rope further comprises the step of moving the second end of the rope such that the second end of the rope falls through the loop in the second direction.

14. A method in accordance with claim 9 wherein said step of moving the rope to insert the second end further comprises the step of moving the loop in the first direction to permit the second end of the rope to pass through the loop.

15. A method in accordance with claim 9 further comprising the step of weighting the second end of the rope prior to tying the knot in the rope.

16. A method in accordance with claim 9 further comprising the step of repeating the steps recited in claim 9 to tie a plurality of knots in the rope.

* * * * *